US011266211B1

(12) United States Patent
Ciatto Corso

(10) Patent No.: US 11,266,211 B1
(45) Date of Patent: Mar. 8, 2022

(54) EARRING FINDING

(71) Applicant: Carmela Max Ciatto Corso, Rehoboth, MA (US)

(72) Inventor: Carmela Max Ciatto Corso, Rehoboth, MA (US)

( * ) Notice: Subject to any disclaimer, the term of this patent is extended or adjusted under 35 U.S.C. 154(b) by 0 days.

(21) Appl. No.: 17/466,365

(22) Filed: Sep. 3, 2021

Related U.S. Application Data

(60) Provisional application No. 63/207,325, filed on Feb. 23, 2021.

(51) Int. Cl.
*A44C 7/00* (2006.01)

(52) U.S. Cl.
CPC ..... *A44C 7/006* (2013.01)

(58) Field of Classification Search
CPC ..... A44C 7/00; A44C 7/004; A44C 7/006; A44C 7/009; A44C 7/007; A44C 7/002; A44C 7/008
USPC ..... 63/14.1, 14.2, 14.3, 14.4, 14.5; D11/42, D11/86, 87, 88; 24/499, 511
See application file for complete search history.

(56) References Cited

U.S. PATENT DOCUMENTS 178,040 A * 5/1876 Yeoman ..... A44C 7/006 63/14.4
208,230 A * 9/1878 Fuller ..... A44C 7/00 63/12
2,230,984 A * 2/1941 Chernow ..... A44C 7/006 63/14.5
2,542,730 A * 2/1951 Thronsen ..... A44C 7/00 63/14.2
2,841,853 A * 7/1958 Guyot ..... A44C 7/006 24/499
2,959,039 A * 11/1960 Jefferies ..... A44C 7/004 63/14.5
D189,793 S * 2/1961 Howard ..... D11/42
3,020,734 A * 2/1962 Withers ..... A44C 7/006 63/14.4
D388,357 S * 12/1997 Montaquila ..... D11/88
D388,734 S * 1/1998 Montaquila ..... D11/88
D394,821 S * 6/1998 Montaquila ..... D11/42
D423,979 S * 5/2000 Montaquila ..... D11/88
D533,803 S * 12/2006 Corso ..... D11/42
D780,035 S * 2/2017 Bulgari ..... D11/42

* cited by examiner

*Primary Examiner* — Jack W Lavinder
(74) *Attorney, Agent, or Firm* — Salter & Michaelson

(57) ABSTRACT

An earring clip for supporting an elongated jewelry item having a substantially planar backing surface. The earring clip includes a top loop that terminates in a spherical member that is for support at a base of the pinna of the ear of the user; an intermediate section that is contiguous with the top loop and that includes at least one contact pad that is secured to the substantially planar backing surface of the elongated jewelry item in order to support the elongated jewelry item from the earring clip; and a lower loop that is contiguous with the intermediate section and that terminates in an end location. The earring clip further includes a pivot leg that is hinged at the end location of the lower loop, and has both an open position wherein the pivot leg is disposed away from the spherical member to enable the earring clip to engage about the ear of the user, and a closed position wherein the pivot leg is closed toward the spherical member in order to hold the earring clip in place.

18 Claims, 6 Drawing Sheets

EARRING FINDING

RELATED CASES

Priority for this application is hereby claimed under 35 U.S.C. § 119(e) to commonly owned and U.S. Provisional Patent Application No. 63/207,325 which was filed on Feb. 23, 2021 and which is incorporated by reference herein in its entirety.

TECHNICAL FIELD

The present invention relates in general to an earring finding or clip for supporting an elongated jewelry item. More particularly, the present invention in relates to an improved earring finding or clip that can be supported from the ear without requiring any particular attachment means.

BACKGROUND OF THE INVENTION

Various designs of an earring clip have been used. However, the majority of these clips require some type of a special attachment device to the ear. It is an object of the to provide an improved earring clip for supporting a jewelry item; particularly an elongated jewelry item that has a substantially planar backing surface.

SUMMARY OF THE INVENTION

To accomplish the foregoing and other objects of the present invention there is provided an earring clip for supporting an elongated jewelry item having a substantially planar backing surface. The earring clip including a top loop that terminates in a spherical member that is for support at a base of the pinna of the ear of the user; an intermediate section that is contiguous with the top loop and that includes at least one contact pad that is secured to the substantially planar backing surface of the elongated jewelry item in order to support the elongated jewelry item from the earring clip; a lower loop that is contiguous with the intermediate section and that terminates in an end location; and a pivot leg that is hinged at the end location of the lower loop, and has both an open position wherein the pivot leg is disposed away from the spherical member to enable the earring clip to engage about the ear of the user, and a closed position wherein the pivot leg is closed toward the spherical member in order to hold the earring clip in place.

In accordance with other aspects of the present invention the top loop is partially circular in shape; the lower loop is partially circular in shape; the intermediate section has a pair of spaced apart contact pads with each contact pad being secured to spaced apart locations along the substantially planar backing surface of the elongated jewelry piece; the intermediate section has a peak between the spaced apart locations so as to space the peak from the substantially planar backing surface of the elongated jewelry item; the intermediate section has a pair of spaced apart contact pads with each contact pad being secured to spaced apart locations along the substantially planar backing surface of the elongated jewelry item; the pivot leg is biased toward the spherical member in the closed position thereof; the pivot leg includes a spring that is mounted thereto in order to provide a biasing force closing the pivot leg toward the spherical member; the spring is a leaf spring; the elongated jewelry item is comprised of a series of individual jewelry pieces each having an individual planar surface segment; further including a support post that ties together each of the series of individual jewelry pieces; and wherein each support post is located spaced from the individual planar surface segments.

In another version of the present invention there is provided an earring clip for supporting an elongated jewelry item having a substantially planar backing surface. The earring clip includes a top loop that terminates in a spherical member that is for support at a base of the pinna of the ear of the user; an intermediate section that is contiguous with the top loop and that includes at least one contact pad that is secured to the substantially planar backing surface of the elongated jewelry item in order to support the elongated jewelry item from the earring clip; a lower loop that is contiguous with the intermediate section and that terminates in an end location; and a pivot leg that is hinged at the end location of the lower loop, and has both an open position wherein the pivot leg is disposed away from the spherical member to enable the earring clip to engage about the ear of the user, and a closed position wherein the pivot leg is closed toward the spherical member in order to hold the earring clip in place; and wherein the intermediate section has a pair of spaced apart contact pads with each contact pad being secured to spaced apart locations along the substantially planar backing surface of the elongated jewelry item.

In accordance with other aspects of the present invention the top loop and the lower loop are both partially circular in shape; the pivot leg is biased toward the spherical member in the closed position thereof; the pivot leg includes a spring that is mounted thereto in order to provide a biasing force closing the pivot leg toward the spherical member; and the spring is a leaf spring.

In still another version of the present invention there is provided an earring clip for supporting an elongated jewelry item having a substantially planar backing surface. The earring clip includes a top loop that terminates in a spherical member that is for support at a base of the pinna of the ear of the user; an intermediate section that is contiguous with the top loop and that includes at least one contact pad that is secured to the substantially planar backing surface of the elongated jewelry item in order to support the elongated jewelry item from the earring clip; a lower loop that is contiguous with the intermediate section and that terminates in an end location; and a pivot leg that is hinged at the end location of the lower loop, and has both an open position wherein the pivot leg is disposed away from the spherical member to enable the earring clip to engage about the ear of the user, and a closed position wherein the pivot leg is closed toward the spherical member in order to hold the earring clip in place; and wherein the intermediate section has a pair of spaced apart contact pads that each are secured with respective spaced apart individual jewelry pieces.

In accordance with still other aspects of the present invention the intermediate section has a pair of spaced apart contact pads with each contact pad being secured to spaced apart locations along the substantially planar backing surface of the elongated jewelry item; and wherein the pivot leg is biased toward the spherical member in the closed position thereof; and the pivot leg includes a spring that is mounted thereto in order to provide a biasing force closing the pivot leg toward the spherical member; and wherein the spring is a leaf spring.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 1:
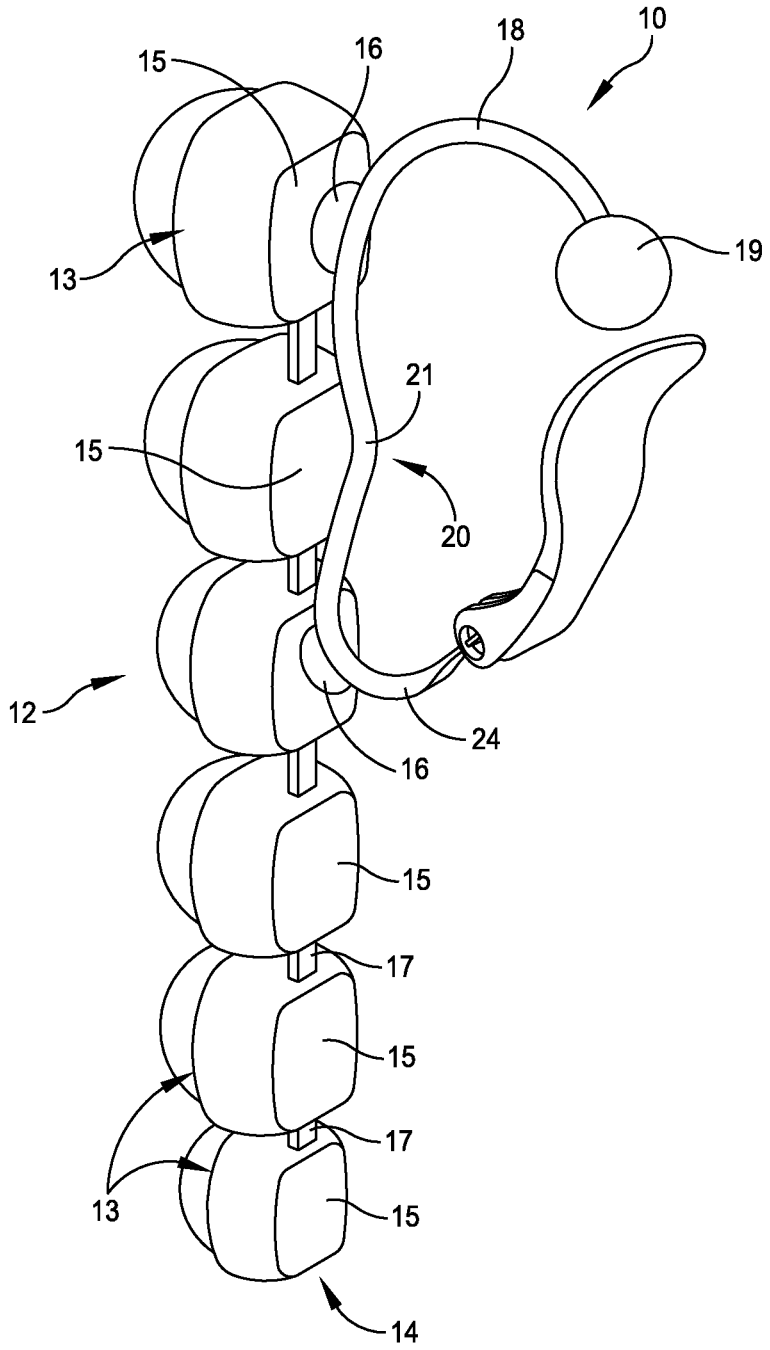
FIG. 1 is a rear perspective view of the earring clip in its closed position.

Reference is now made to the drawings and in particular FIGS. 1-8 that illustrate a preferred embodiment of the present invention. There is illustrated an earring clip 10 for supporting an elongated jewelry item 12. The jewelry item 12 may be considered as having a substantially planar backing surface 14. This backing surface may be comprised of a series of surface segments 15 each one associated with a particular individual jewelry piece 12.

Figure 7:
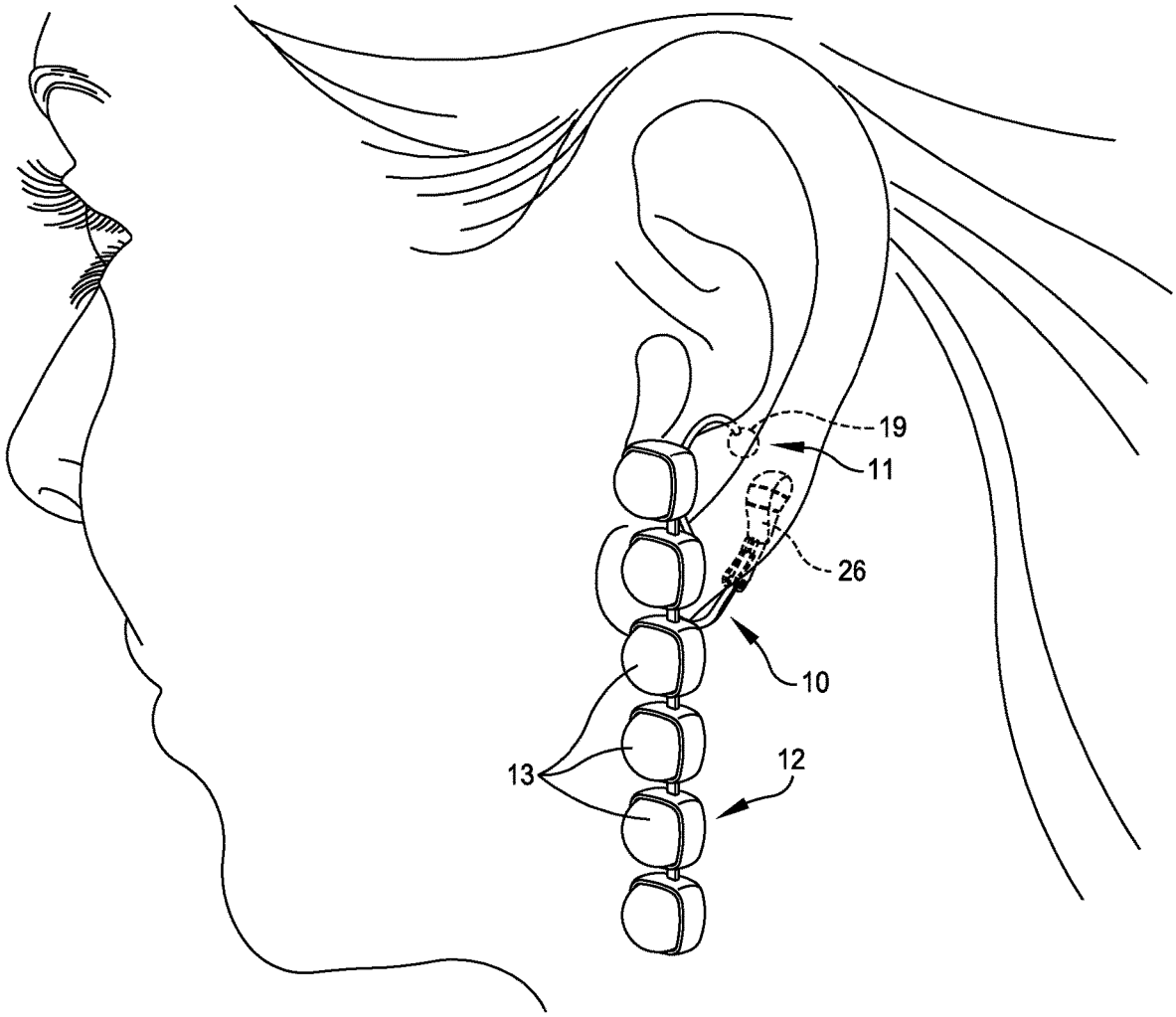
FIG. 7 illustrates the earring clip of the present invention as in use.
Figure 8:
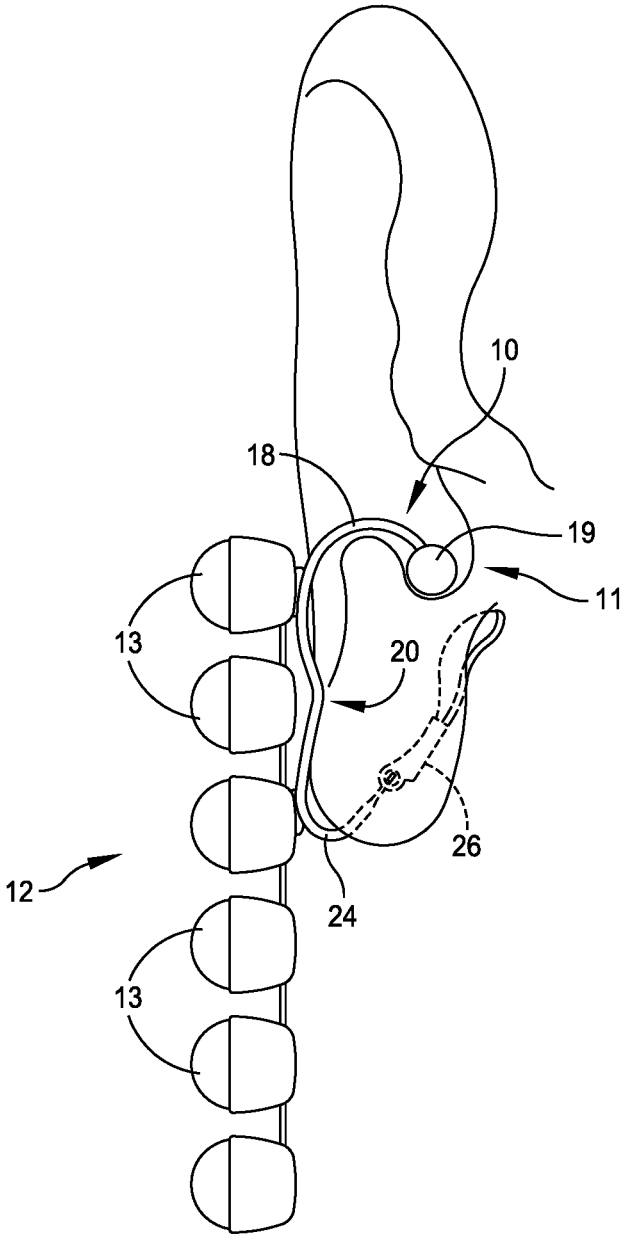
FIG. 8 is a side view of the earring clip as attached to the ear.

The earring clip 10 is meant for support from the ear pinna 11 such as illustrated in FIGS. 7 and 8. Both FIGS. 7 and 8 illustrate the clip in its closed position with the pivot leg 26 pivoted toward the spherical member 19. This arrangement secures the earring clip 10 about the ear with the spherical member 19 resting within the ear pinna 11.

The earring clip 10 includes a top loop 18 that terminates at the spherical member 19. As indicated, the spherical member is dimensioned to snugly fit at the base of the pinna of the ear of the user Again, reference may be made to FIGS. 7 and 8.

The earring clip 10 also includes an intermediate section 20 that is contiguous with the top loop 18 and includes at least one contact pad 16 that is secured to the substantially planar backing surface of the elongated jewelry item in order to support the jewelry item from the earring clip. The contact pad 16 may be constructed of a metal material and interconnects and fuses together the planar surface segment 15 with a portion of the intermediate section 20.

Figure 3:
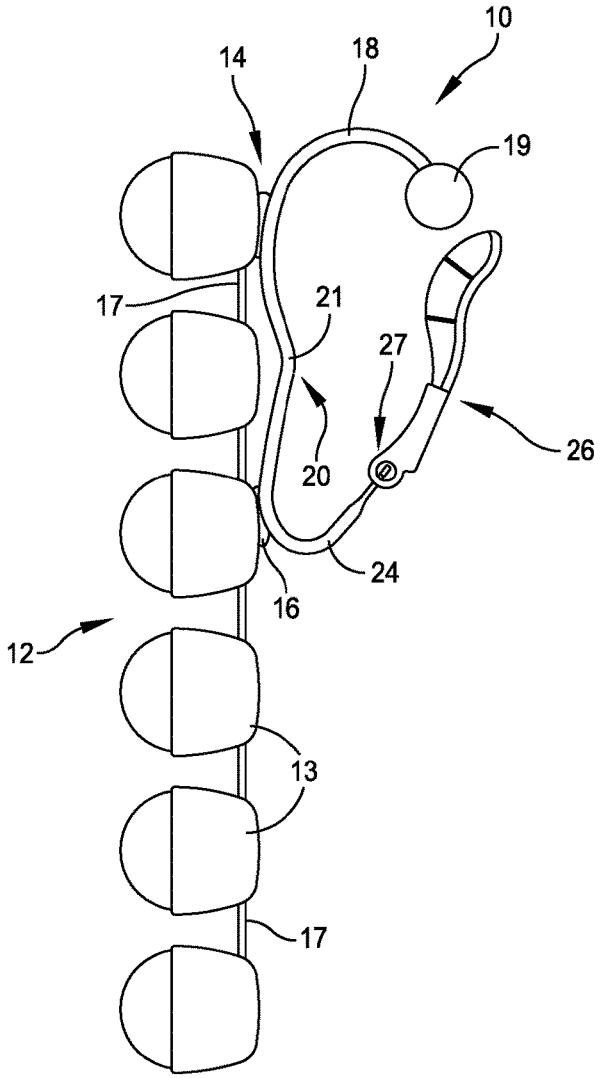
FIG. 3 is a side view of the earring clip in its closed position.
Figure 4:
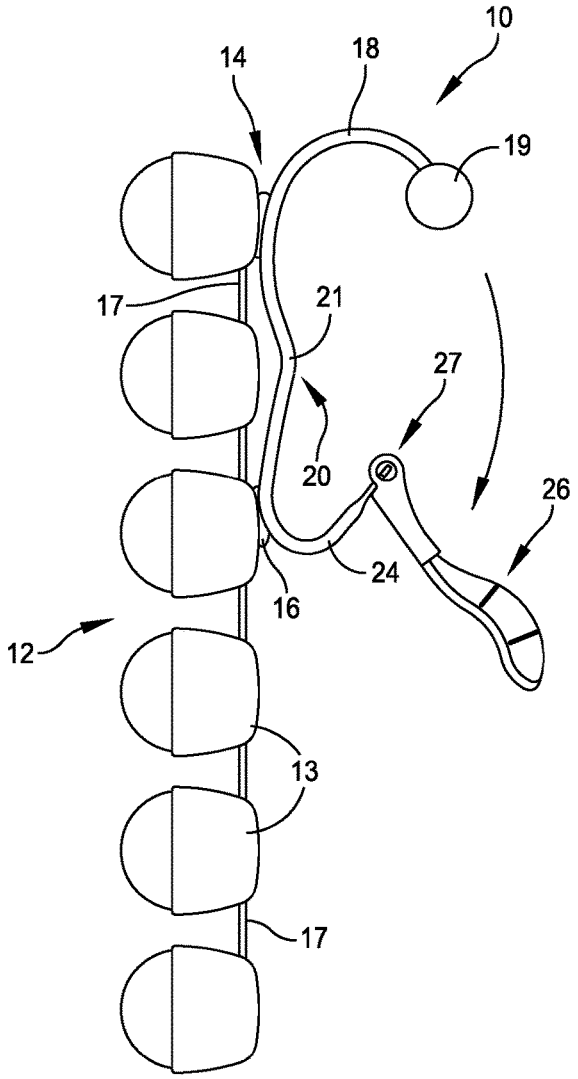
FIG. 4 is a side view of the earring clip in its closed position.
Figure 5:
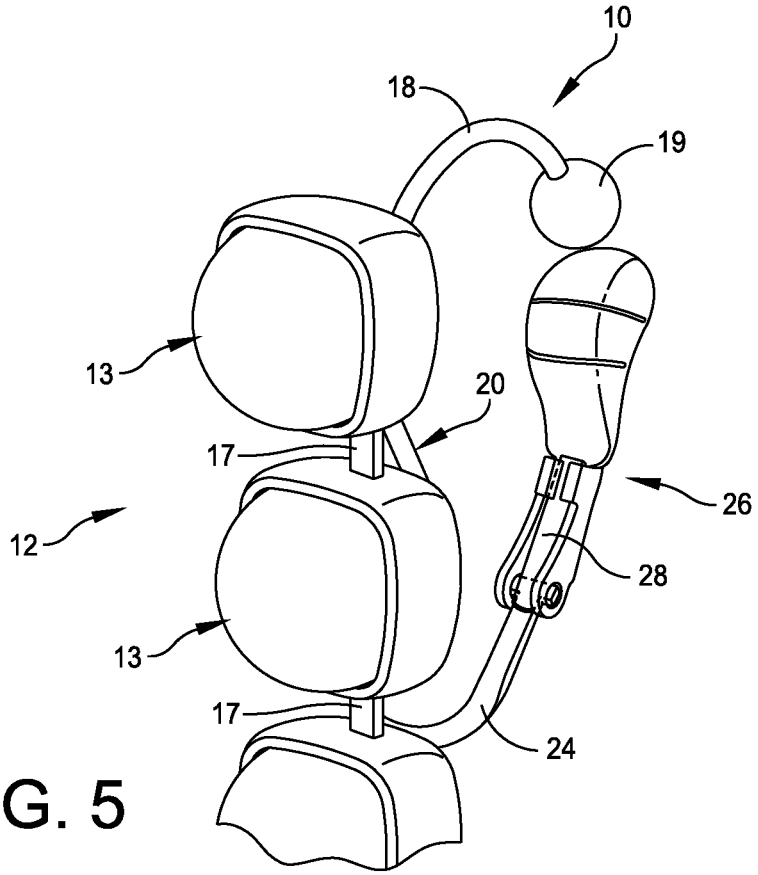
FIG. 5 is a front partial perspective view with the earring clip in its closed position.
Figure 6:
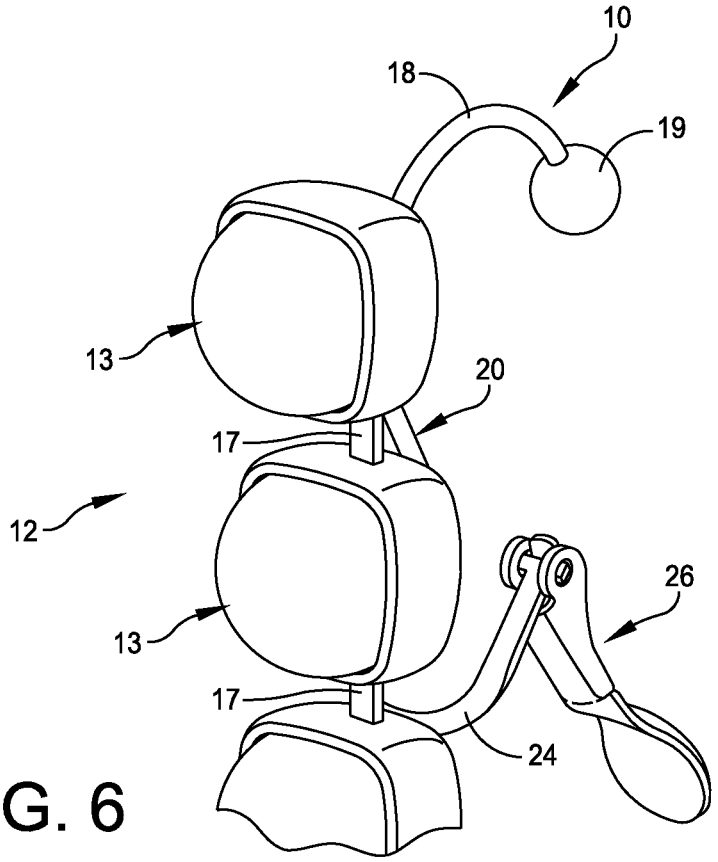
FIG. 6 is a front partial perspective view with the earing clip in its open position.

The earing clip also includes a lower loop 24 that is contiguous with the intermediate section 20 and that terminates in an end location. A pivot leg 26 is hinged at this end location of the lower loop. The pivot leg 26 has both an open position such as illustrated in FIGS. 4 and 6 wherein the pivot leg is disposed away from the spherical member 19 to enable the earring clip to engage about the ear of the user. Reference may also be made to FIGS. 3 and 5 for an illustration of a closed position of the pivot leg wherein the pivot leg 26 is closed toward the spherical member 19 in order to hold the earring clip in place. This closed position is also illustrated in FIGS. 7 and 8.

In accordance with other aspects of the present invention the top loop 18 is considered as being partially circular in shape. Similarly, the lower loop 24 is also considered as being partially circular in shape. In the embodiment illustrated in the drawings, the intermediate section 20 has a peak illustrated at 21 in FIG. 1 that is disposed between the spaced apart locations of the contact pads 16. Refer in particular to FIGS. 3 and 4 showing the peak at 21 and the contact pads 16 that are secured to the opposite sides of the peak 21. This arrangement provides a space, as illustrated in FIGS. 3 and 4, between one of the individual jewelry pieces and the intermediate section 20.

The pivot leg 26 is biased toward the spherical member 19 in the closed position. The pivot leg 36 includes a spring 28 that is mounted thereto in order to provide a biasing force closing the pivot leg toward the spherical member as the pivot leg is pivoted to the closed position. The elongated jewelry piece is preferably comprised of a series of individual jewelry pieces 13 each having an individual planar support surface at 15. The elongated jewelry item is also preferably interconnected by means of a series of support posts 17. The support posts 17 connect between adjacent jewelry pieces 13. It is also noted in, for example, FIGS. 3 and 4 that each of the posts 17 is spaced from the individual planar surface segments 15.

Figure 2:
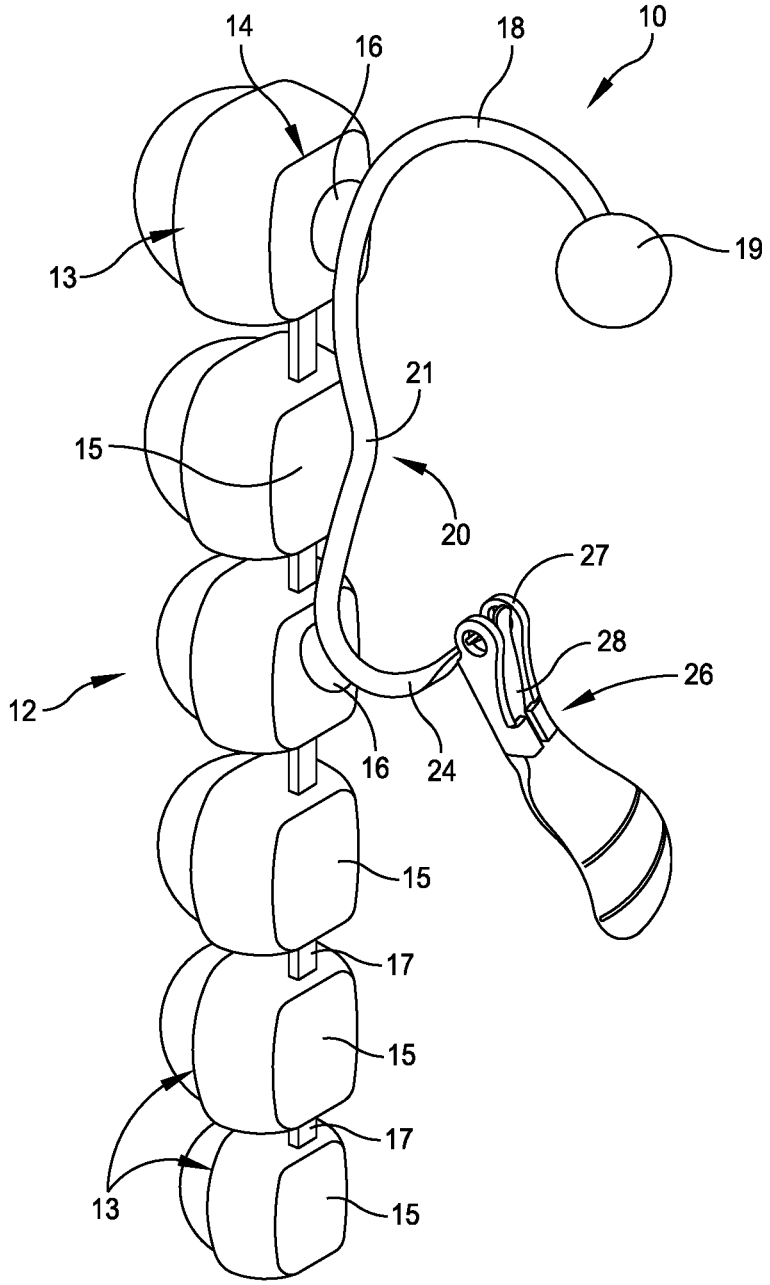
FIG. 2 is a rear perspective view of the earring clip in its open position.

With regard to FIGS. 3 and 4, it is noted that the pivot leg 26 can be manually pivoted at the pivot joint 27. FIG. 4 illustrates the pivot leg in its open position. FIG. 3 illustrates the pivot leg 36 moved to its closed position under the bias of the leaf spring 28. Refer, for example, to FIG. 2 for the position of the leaf spring 28. The leaf spring 28 is constructed and arranged so that the pivot leg is either biased toward an open position as in FIG. 4, or once moved, is biased towards a closed position as illustrated in FIG. 3.

REFERENCE NUMBERS

10 earring clip
11 ear pinna
12 jewelry item
13 series of individual jewelry pieces
14 planar backing surface
15 surface segments
16 contact pad
17 jewelry items support post
18 top loop
19 spherical member
20 intermediate section
21 intermediate section peak
24 lower loop
26 pivot leg
27 pivot joint
28 leaf spring

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. An earring clip for supporting an elongated jewelry item having a substantially planar backing surface, said earring clip including a top loop that terminates in a spherical member that is for support at a base of the pinna of the ear of the user; said earring clip further constructed with an intermediate section that is contiguous with the top loop and that includes at least one contact pad that is secured to the substantially planar backing surface of the elongated jewelry item in order to support the elongated jewelry item from the earring clip; said earring clip further constructed with a lower loop that is contiguous with the intermediate section and that terminates in an end location; said earring clip further including a pivot leg that is hinged at the end location of the lower loop, and has both an open position wherein the pivot leg is disposed away from the spherical member to enable the earring clip to engage about the ear of the user, and a closed position wherein the pivot leg is closed toward the spherical member in order to hold the earring clip in place wherein said at least one contact pad is a pair of spaced apart contact pads with each contact pad being secured to spaced apart locations along the substantially planar backing surface of the elongated jewelry item.

2. The earring clip of claim 1 wherein the top loop is partially circular in shape.

3. The earring clip of claim 2 wherein the lower loop is partially circular in shape.

4. The earring clip of claim 1 wherein the intermediate section has a peak between the spaced apart locations so as to space the peak from the substantially planar backing surface of the elongated jewelry item.

5. The earring clip of claim 1 wherein the pivot leg is biased toward the spherical member in the closed position thereof.

6. The earring clip of claim 5 wherein the pivot leg includes a spring that is mounted thereto in order to provide a biasing force closing the pivot leg toward the spherical member.

7. The earring clip of claim 6 wherein the spring is a leaf spring.

8. An earring clip for supporting an elongated jewelry item having a substantially planar backing surface, said earring clip including a top loop that terminates in a spherical member that is for support at a base of the pinna of the ear of the user; said earring clip further constructed with an intermediate section that is contiguous with the top loop and that includes at least one contact pad that is secured to the substantially planar backing surface of the elongated jewelry item in order to support the elongated jewelry item from the earring clip; said earring clip further constructed with a lower loop that is contiguous with the intermediate section and that terminates in an end location; said earring clip further including a pivot leg that is hinged at the end location of the lower loop, and has both an open position wherein the pivot leg is disposed away from the spherical member to enable the earring clip to engage about the ear of the user, and a closed position wherein the pivot leg is closed toward the spherical member in order to hold the earring clip in place wherein the elongated jewelry item is comprised of a series of individual jewelry pieces each having an individual planar surface segment.

9. The earring clip of claim 8 further including a support post that tics together each of the series of individual jewelry pieces.

10. The earring clip of claim 8 wherein each support post is located spaced below the individual planar surface segments.

11. The earring clip of claim 8 wherein the pivot leg is biased toward the spherical member in the closed position thereof.

12. The earring clip of claim 11 wherein the pivot leg includes a spring that is mounted thereto in order to provide a biasing force closing the pivot leg toward the spherical member.

13. The earring clip of claim 12 wherein the spring is a leaf spring.

14. An earring clip for supporting an elongated jewelry item having a substantially planar backing surface, said earring clip including a top loop that terminates in a spherical member that is for support at a base of the pinna of the ear of the user; said earring clip further constructed with an intermediate section that is contiguous with the top loop and that includes at least one contact pad that is secured to the substantially planar backing surface of the elongated jewelry item in order to support the elongated jewelry item front the earring clip; said earring clip further constructed with a lower loop that is contiguous with the intermediate section and that terminates in an end location; said earring clip further including a pivot leg that is hinged at the end location of the lower loop, and has both an open position wherein the pivot leg is disposed away from the spherical member to enable the earring clip to engage about the ear of the user, and a closed position wherein the pivot leg is closed toward the spherical member in order to hold the earring clip in place; and wherein said at least one contact pad is a pair of spaced apart contact pads with each contact pad being secured to spaced apart locations along the substantially planar backing surface of the elongated jewelry item.

15. The earring clip of claim 14 wherein the top loop and the lower loop are both partially circular in shape.

16. An earring clip for supporting an elongated jewelry item having a substantially planar backing surface, said earring clip including a top loop that terminates in a spherical member that is for support at a base of the pinna of the ear of the user; said earring clip further constructed with an intermediate section that is contiguous with the top loop and that includes at least one contact pad that is secured to the substantially planar backing surface of the elongated jewelry item in order to support the elongated jewelry item from the earring clip; said earring clip further constructed with a lower loop that is contiguous with the intermediate section and that terminates in an end location; said earring clip further including a pivot leg that is hinged at the end location of the lower loop, and has both an open position wherein the pivot leg is disposed away from the spherical member to enable the earring clip to engage about the ear of the user, and a closed position wherein the pivot leg is closed toward the spherical member in order to hold the earring clip in place; and wherein said at least one contact pad is a pair of spaced apart contact pads that each are secured with respective spaced apart individual jewelry pieces.

17. The earring clip of claim 16 wherein the intermediate section has a pair of spaced apart contact pads with each contact pad being secured to spaced apart locations along the substantially planar backing surface of the elongated jewelry item; and wherein the pivot leg is biased toward the spherical member in the closed position thereof.

18. The earring clip of claim 17 wherein the pivot leg includes a spring that is mounted thereto in order to provide a biasing force closing the pivot leg toward the spherical member; and wherein the spring is a leaf spring.

* * * * *